United States Patent [19]

Everett

[11] 4,221,081

[45] Sep. 9, 1980

[54] DUST COLLECTOR SYSTEM FOR BELT SANDER

[76] Inventor: Charles T. Everett, P.O. Box 2068, Warren, Ohio 44484

[21] Appl. No.: 937,603

[22] Filed: Aug. 28, 1978

[51] Int. Cl.[3] ..... B24B 21/00

[52] U.S. Cl. ..... 51/135 R; 51/270; 51/273

[58] Field of Search ..... 51/135 R, 270, 273, 51/356; 29/DIG. 79; 144/252 R

[56] References Cited

U.S. PATENT DOCUMENTS

| | | | |
|---|---|---|---|
| 776,156 | 11/1904 | Venderbush | 51/273 |
| 1,642,171 | 9/1927 | Reavis | 51/135 R |
| 2,291,550 | 7/1942 | Heinichen | 51/273 |
| 2,384,414 | 9/1945 | Antrim | 51/273 |
| 2,565,510 | 8/1951 | Martin | 51/273 |
| 2,629,209 | 2/1953 | Miller | 51/273 |
| 2,683,958 | 7/1954 | Schneible | 51/273 |
| 2,763,972 | 9/1956 | White | 51/273 |
| 3,514,906 | 6/1970 | Everett | 51/273 |

FOREIGN PATENT DOCUMENTS

| | | | |
|---|---|---|---|
| 1133999 | 7/1962 | Fed. Rep. of Germany | 51/273 |

*Primary Examiner*—Harold D. Whitehead
*Assistant Examiner*—K. Bradford Adolphson
*Attorney, Agent, or Firm*—Michael Williams

[57] ABSTRACT

A dust collecting system for belt sanders and the like which prevents dust and grit produced during the sanding of objects from entering the air which the operator breathes. The system serves as the closed base or stand for the belt sander, contains a powered air moving device, a baffle to trap larger particles of grit, a standard furnace filter to remove dust and smaller particles of grit, a control switch to start and stop the sander, a filter examination and removal plate and a cleanout plate.

4 Claims, 2 Drawing Figures

DUST COLLECTOR SYSTEM FOR BELT SANDER

BACKGROUND OF THE INVENTION

The present invention relates to dust collection systems for belt sanders and the like. More specifically the invention relates to a dust collection system and air filter system which serves as the stand on which the belt sander is mounted. The operator controls both the sander and the powered air moving system of the dust collector by means of a single switch. Baffles within the dust collector enclosure separate the heavy solid particles of grit and waste from the lighter airborne particles. A standard furnace filter extracts the finer particles before the air is returned to the region outside of the collector.

Heretofore, dust collector systems combined with belt sanders have been complex, heavy, not easily moved from place to place and so costly as to prevent their wide use. Operators of belt sanders with dust collectors often operated the sander independently of the dust collector, particularly when the sander was needed only for a rather short time. The dust collector became a nuisance to the operator. Introduction of dust, grit and particles into the air appeared not to be objectionable particularly during these short periods of use.

Increased attention to the air purity in the working environment has been brought about by the Occupational Safety and Health Act as well as by various state and industry health and safety boards. There is a need for a simple, low cost effective dust collector system for belt sanders which is activated each and every time the sander is operated.

SUMMARY OF THE INVENTION

It is, therefore, an object of the present invention to provide a dust collecting system for belt sanders and the like.

It is another object of the present invention to provide a dust collecting system which serves as the base or table for a belt sander.

It is another object of the present invention to provide a belt sander and dust collector combination which can be readily moved about from one location to another.

It is a further object of the present invention to provide a simple, low cost dust collecting system for belt sanders which utilizes standard furnace filters to remove the finer airborne particles of dust, grit and waste from the air before it is returned to the breathing space of the operator.

It is still another object of the present invention to provide a belt sander and dust collector combination in which a single control switch operates both the sander and the dust collector and in which the belt sander cannot be operated without the associated dust collector system.

These and other objects of the present invention, together with the advantages thereof over the existing prior art which will become apparent from the specification, are accomplished by the improvements hereinafter described and claimed.

DESCRIPTION OF THE PREFERRED EMBODIMENT

Figure 1:
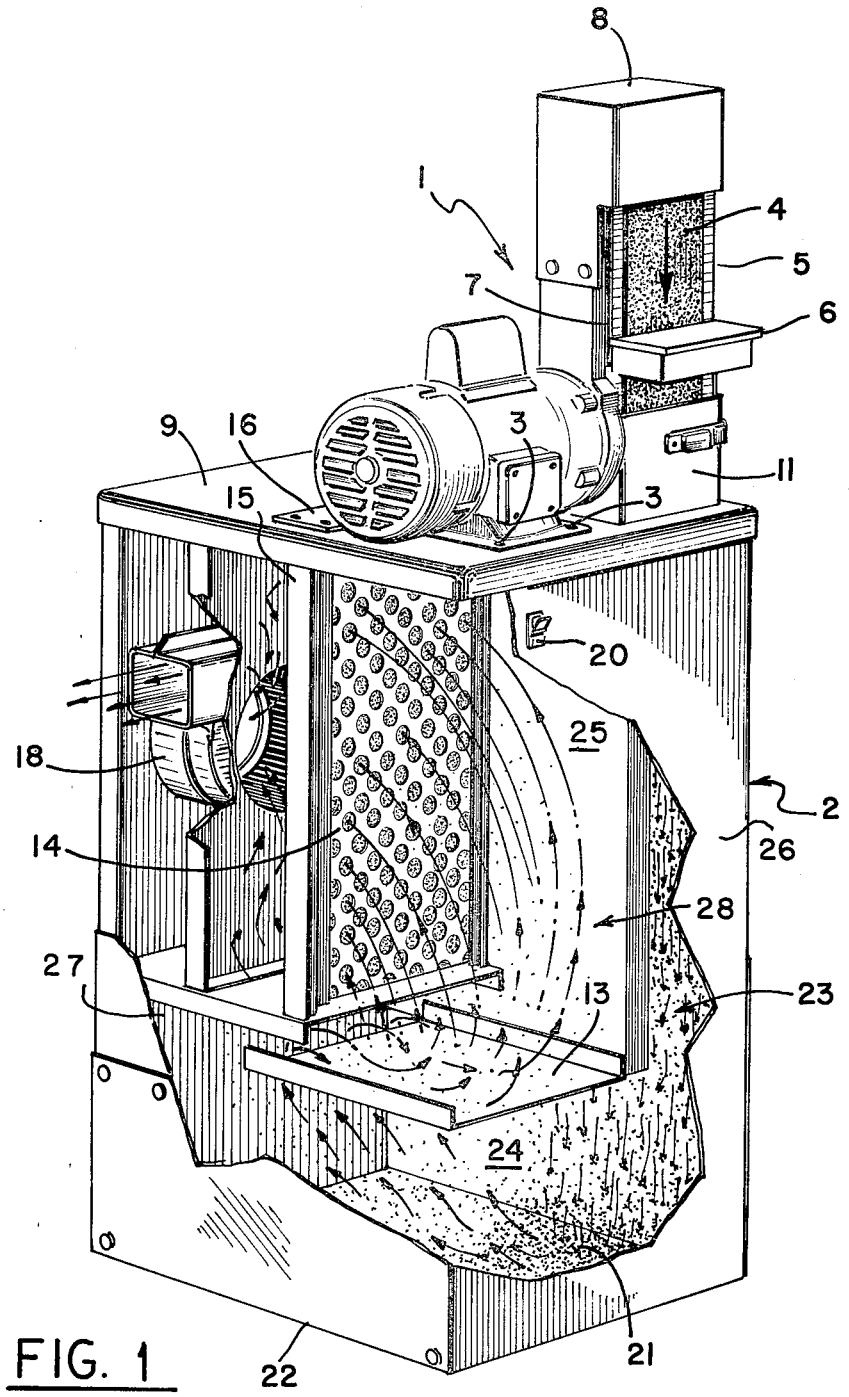
FIG. 1 is a perspective view of the combination of a belt sander and dust collector control base or stand.
Figure 2:
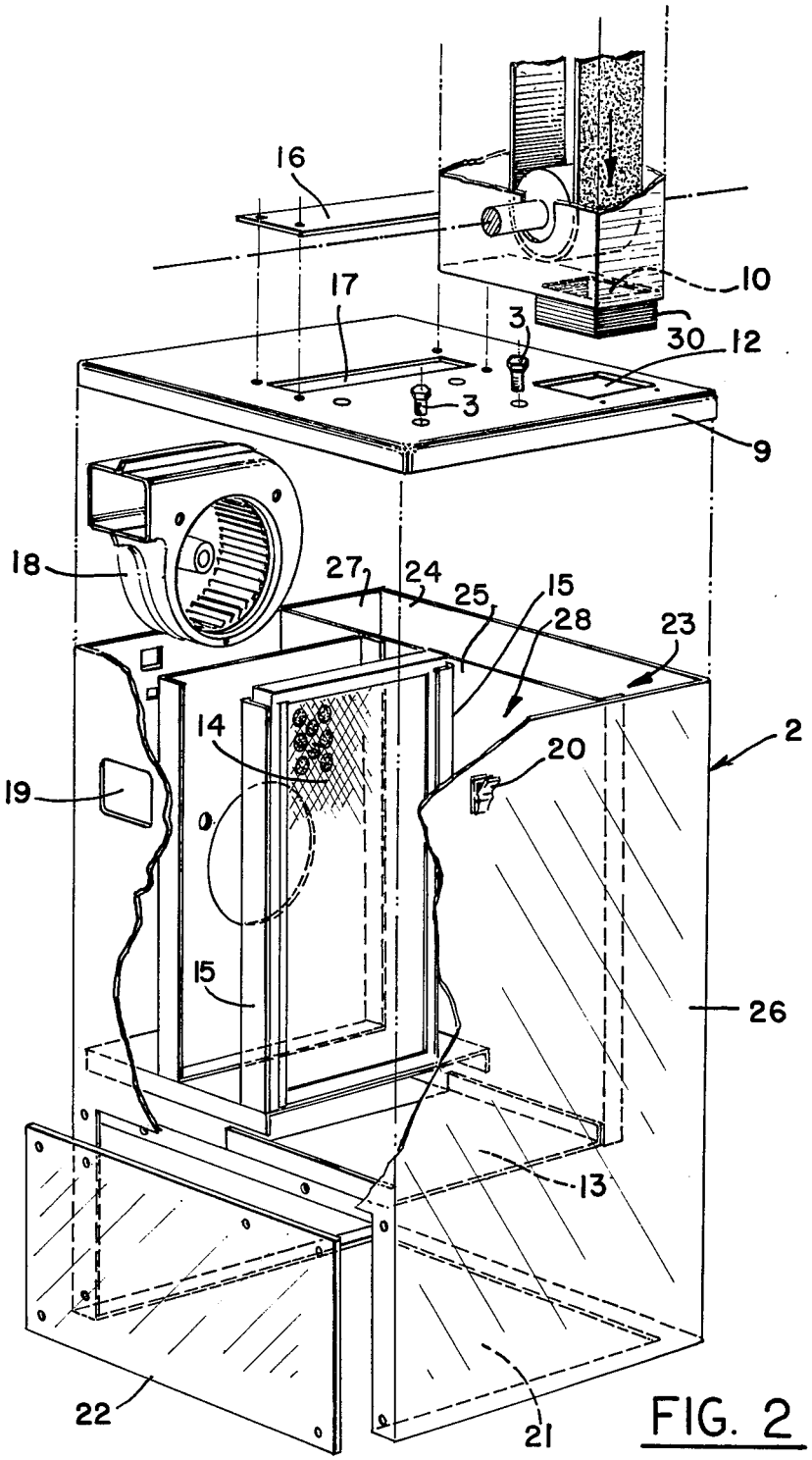
FIG. 2 is an exploded view of the dust collector control base or stand.

The belt sander is shown in FIG. 1 generally by the numeral 1 and the dust collecting stand is shown generally by the numeral 2. The belt sander 1 is mounted on top 9 of the stand 2 by bolts 3. The object to be sanded is held against the belt 4, and is supported on rest 6 at the opening 5 front wall 11 of in the housing 8. The belt has sliding engagement with a fixed vertical member 7 which provides a backup for the belt. At the bottom of the housing 8 depending peripheral flange 30 defines a passage 10, shown in the exploded view of FIG. 2, permits grit, dust and waste particles from the object being polished or sanded to pass through the top 9 of the stand 2 by passage 12. A fan 18 creates a reduced air pressure at the passage 12 causing the grit, dust and particles to be pulled vertically downward through a first vertical space or chamber 23 of the dust collector stand. Space 23 is defined generally between a side wall 24 of the stand or cabinet 2 and the vertically disposed transverse baffle 25 which extends between opposed front and rear walls 26 and 27 of the cabinet. Many of the heavy particles remain at the bottom of the cabinet on the bottom wall thereof where they can be removed by opening the cleanout cover 22. The air flow created by the fan is directed below baffle 25 and beneath generally horizontally or perpendicularly extending portion 13 thereof where more particles are deposited at the bottom of the stand or cabinet. The air flow containing only the finer airborne particles passes generally upwardly into a second vertical space or chamber 28 and through filter 14. After passing through the filter 14 the air enters the fan housing 18 from which it is discharged through the discharge opening 19 to the surrounding air space.

The filter 14 rests in generally vertically disposed guides 15 and is cleaned or changed by removing filter access plate 16 over the opening 17, exposing the top edge of the filter.

Switch 20 controls both the belt sander 1 and the fan motor so that the sander cannot be operated without operating the dust collector. The location and function of the switch 20, together with the dust collector device, serving as the belt sander stand 2, results in a convenient low cost, effective combination which substantially reduces the introduction of dust and particles into the breathing space of the operator.

The belt sander and dust collector illustrated and described in detail in this specification, in accordance with the Patent Statutes is the preferred embodiment. It is to be understood that the invention is not limited thereto, since it will be apparent to those skilled in the art that a number of modifications, alternatives and other variations are possible. Accordingly, the invention should be considered to include all variations and alterations falling within the scope of the appended claims.

I claim:

1. A belt sander and dust-collector assembly comprising:

an upright pedestal formed as an enclosing cabinet of generally rectangular cross-section and having pairs of opposed side walls, a bottom, and a top cover, a generally vertically disposed baffle within said cabinet extending between a pair of said opposed side walls thereof to divide the cabinet interior into first and second vertical spaces, said baffle extending from the top of said cabinet to a point vertically spaced from the bottom thereof so that said vertical spaces are in communication at lower ends thereof, said top cover having an opening therethrough communicating with said first vertical space, an enclosing housing attached to said top cover and extending vertically upwardly therefrom and having an endless pulley-driven sanding belt operably mounted therein to provide a generally vertical working surface, said housing having a opening in a wall thereof through which a workpiece may be disposed for sanding engagement with said belt, said housing also having an opening at its lower end aligned with said cover opening thereby to establish communication between said housing and said first vertical space, a motor-driven blower having an inlet and an outlet with the inlet in communication with the upper portion of said second vertical space, and its outlet communicating with the atmosphere outwardly of said cabinet, said baffle at its lower end having a laterally-extending perpendicular baffle portion spaced from said cabinet bottom and extending into said second vertical space so that the downward air flow in said first vertical space must change direction at substantially right angles to flow under said baffle and said baffle portion through the lower end of said second vertical space and then again change flow direction in passing upwardly in said second vertical space toward said blower inlet, vertically extending guides disposed adjacent said blower inlet in said second vertical space extending from points above said perpendicular baffle portion toward the top of said cabinet, a filter element slidably mounted in said guides for ready insertion and removal therefrom thereby to dispose said filter element substantially perpendicular to said laterally-extending baffle portion and in said air flow when said blower is operating, whereby with said blower in operation, reduced air pressure in said vertical spaces draws sandings downwardly in a tortuous path from said housing into said cabinet through said openings, around said baffle and up through said filter element and into said blower thereby to cause heavier sanding particles to fall to the bottom of said cabinet and only light and fine particles arrive at said filter element.

2. The construction according to claim 1 wherein said top cover has another opening therethrough disposed in general alignment with said filter guides whereby the filter element may be readily inserted or removed, and a detachable cover plate for said another opening.

3. The construction according to claim 1 wherein said enclosing housing includes a generally depending flange about the lower end opening thereof, said flange interfitting with said top cover opening for said enclosing housing.

4. The construction according to claims 1, 2, or 3 further including an electric motor supported on said cabinet top cover and detachably connected thereto, said motor being operatively connected to said pulley-driven sanding belt to drive the same.

* * * * *